US006976613B2

(12) United States Patent
Kim

(10) Patent No.: US 6,976,613 B2
(45) Date of Patent: Dec. 20, 2005

(54) SECURE DISPLAY NECKTIE HOLDER

(75) Inventor: Cin Kim, Montvale, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 72 days.

(21) Appl. No.: 10/650,133

(22) Filed: Aug. 26, 2003

(65) Prior Publication Data

US 2005/0067443 A1 Mar. 31, 2005

(51) Int. Cl.[7] ..... D06C 15/00
(52) U.S. Cl. ..... 223/83
(58) Field of Search ..... 223/83; 2/145, 2/148, 149, 152.1, 153, 154; D2/602

(56) References Cited

U.S. PATENT DOCUMENTS 4,655,375 A * 4/1987 Pazeotopoulos ..... 223/85

* cited by examiner

*Primary Examiner*—John J. Calvert
*Assistant Examiner*—James G Smith
(74) *Attorney, Agent, or Firm*—Darby & Darby

(57) ABSTRACT

Provided is a necktie holder for attachment to a shirt under a shirt button. The shirt button is attached to the shirt by a threading having a width. The necktie holder comprises a flexible body having a tie slot sized for the placement of a tie therein, a channel defined in the flexible body and extending to an interior mouth, and first and second shoulders opposedly positioned within the channel. The shoulders define a constriction proximate the interior mouth, the constriction being smaller than the width of the threading. As a result, the button can be manually urged beyond the first and second shoulders while causing the constriction to resiliently flex the flexible body to momentarily permit passage of the shirt button into the interior mouth. Also provided is a method for securing a necktie to a shirt.

8 Claims, 4 Drawing Sheets

SECURE DISPLAY NECKTIE HOLDER

BACKGROUND OF THE INVENTION

Retailers are discovering that shirt and tie combinations packaged together better meet the needs of a certain class of shoppers. When displaying and selling dress shirts in combination with ties, retailers assist their clients with a fashion choice that can be time consuming. Furthermore, when suitably coordinated, a shirt and a tie combination can make a more attractive display item for sale than if displayed individually.

Unfortunately, some consumers tend to remove and replace ties from their previously associated shirt, and thus create additional costs and difficulties to the retailer. Among other problems created, the individual components are not separately priced. Thus, retailers would benefit from a way to package shirt and tie combinations so that the consumer is discouraged from removing ties from these combinations.

SUMMARY OF THE INVENTION

Provided is a necktie holder for attachment to a shirt under a shirt button. The shirt button is attached to the shirt by a threading having a width. The necktie holder comprises a flexible body having a tie slot sized for the placement of a tie therein, a channel defined in the flexible body and extending to an interior mouth, and first and second shoulders opposedly positioned within the channel. The shoulders define a constriction proximate the interior mouth, the constriction being smaller than the width of the threading. As a result, the button can be manually urged beyond the first and second shoulders while causing the constriction to resiliently flex the flexible body to momentarily permit passage of the shirt button into the interior mouth.

Also provided is a method for securing a necktie to a shirt. The shirt has buttons extending up to a collar. Each shirt button is attached to the shirt by threading. According to the method, a selected shirt button is passed into a channel in a flexible plastic holder. The threading of the selected shirt button is urged past constrictions in the flexible plastic holder until the selected shirt button is seated beyond the constrictions. A length of the necktie is disposed in a tie slot of the flexible plastic holder. The necktie is folded over the flexible plastic holder in order to conceal the flexible plastic holder. The flexible plastic holder is bent so as to position the folded necktie over the selected button, whereby the necktie is secured to the shirt and the flexible plastic holder is concealed beneath the necktie.

DETAILED DESCRIPTION OF CERTAIN EMBODIMENTS

Figure 1:
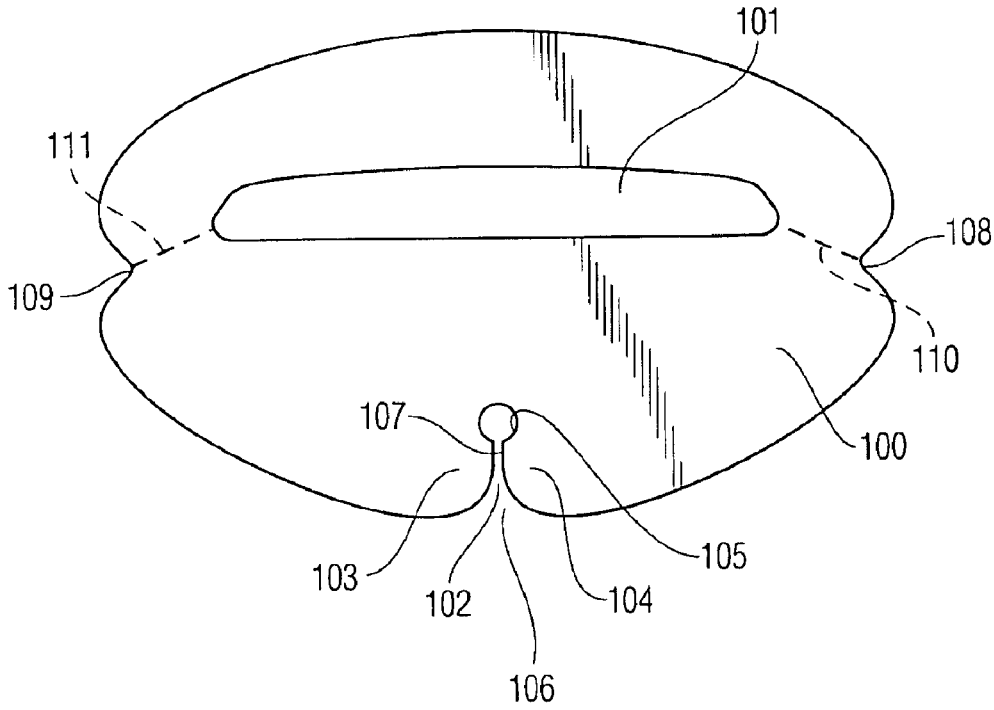
FIG. 1 is a diagram of a necktie holder in accordance with a preferred embodiment.

The necktie holder 100 of a preferred embodiment of the present invention is shown in FIG. 1. In a preferred embodiment, the necktie holder 100 is manufactured from mid-density flexible plastic that is machine cut into a prescribed shape. Examples of plastics that may be used are polyethylene and polypropylene. A variety of other materials may be used, as long as the necktie holder's body is flexible as described below.

A tie slot 101 is defined in an upper part of the necktie holder. The tie slot is sized for the placement of a tie therein. A channel 102 is defined between two shoulders 103 and 104 of the necktie holder body. The channel leads to an interior mouth 105.

The interior mouth 105 is sized so it can accommodate the thread of a shirt button but not the shirt button itself. Thus, the shirt button cannot pass through the interior mouth 105 which permits the necktie holder 100 to be secured to a shirt. In a preferred embodiment, the mouth is a circle with a diameter of 0.4 cm.

The channel extends from an entrance 106 at the lower part of the body to a constriction 107, the constriction being proximate to the interior mouth 105. The channel is wider in its entrance 106 than at the constriction 107. Furthermore, the constriction 107 is narrower than the thread of a shirt button so as to retain the thread once positioned in the mouth 105. In a preferred embodiment the channel is 0.2 cm wide in its entrance 106, and 0.15 cm wide in its constriction 107.

Figure 2:
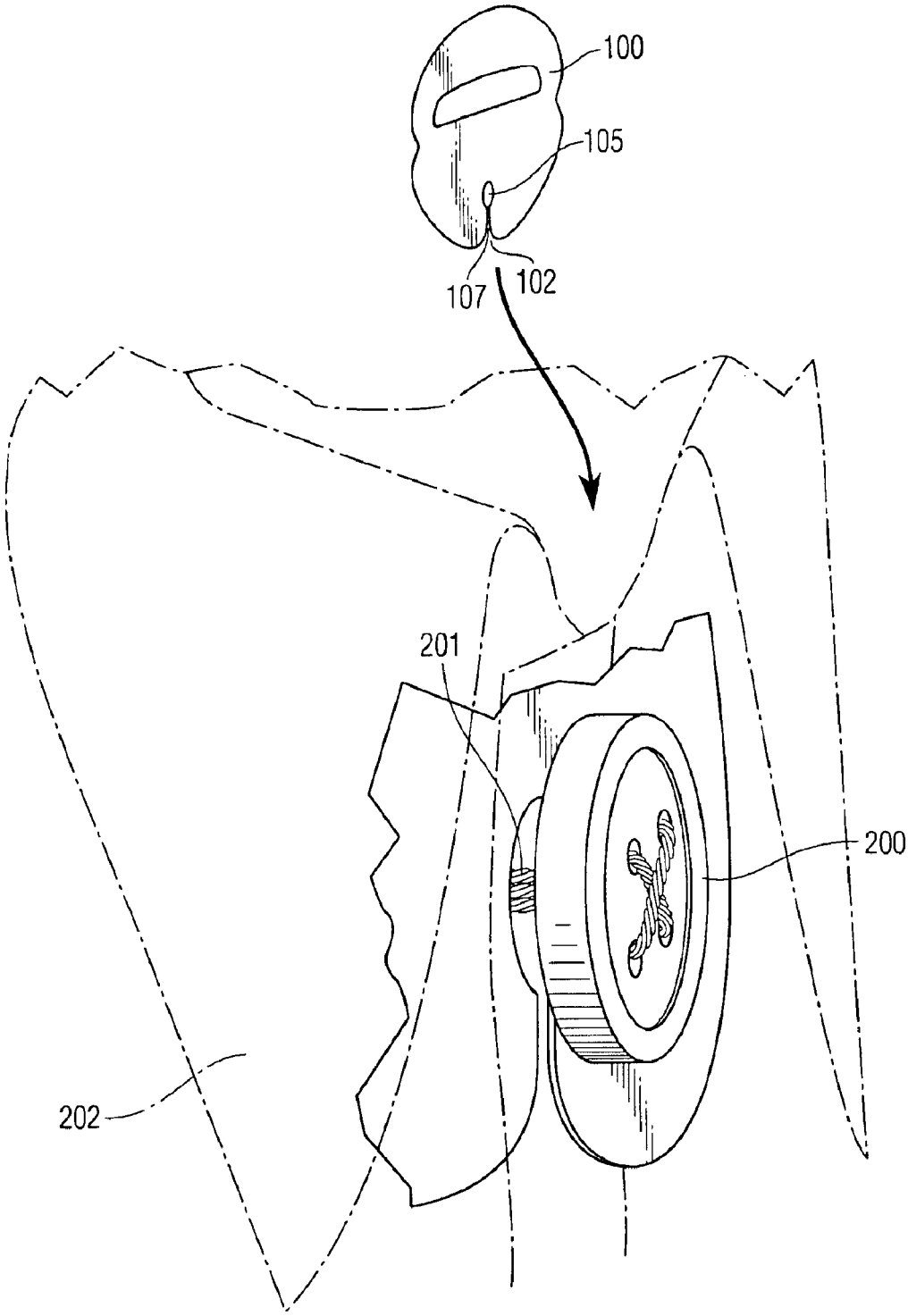
FIG. 2 is a diagram of the necktie holder of FIG. 1 being attached to the shirt button.

FIG. 2 shows the necktie holder 100 being attached to a shirt button. The shirt button 200 is attached to a shirt 202 by threading 201. The necktie holder 100 is guided between the shirt 202 and the shirt button 200, so that the threading 201 enters the channel 102. The necktie holder 100 is urged downward, guiding the threading 201 up the channel 102. Even though the constriction 107 is narrower than the threading 201, the thread can be urged through and past the constriction. As the thread 201 is pressed against the constriction 107 with a manual force it forces the shoulders 103 and 104 to resiliently spread further apart by flexing the body of the necktie holder. As the shoulders spread apart the constriction widens until it is wide enough for the threading to pass through it. Once the threading passes through the constriction, it goes into the interior mouth 105. Once disposed within the interior mouth 105, the shoulders 103 and 104 resiliently return to their original position (see FIG. 1) due to the natural resiliency of the material defining the shoulders. As a result, the flexible body of the necktie holder 100 returns to its initial shape, causing the shoulders to return to their initial positions, and the constriction 107 to return to its original narrow state. Since the constriction 107 is once again narrower than the threading 201, the necktie holder 100 cannot be inadvertently separated from the shirt button absent the manual force.

Although in the presently described embodiment the channel 102 is in the lower side of the necktie holder 100, such placement is not necessary.

Referring again to FIG. 1, a preferred embodiment of the present invention includes two indentations 108 and 109. These indentations facilitate folding the necktie holder 100 along score lines 110 and 111.

Figure 3:
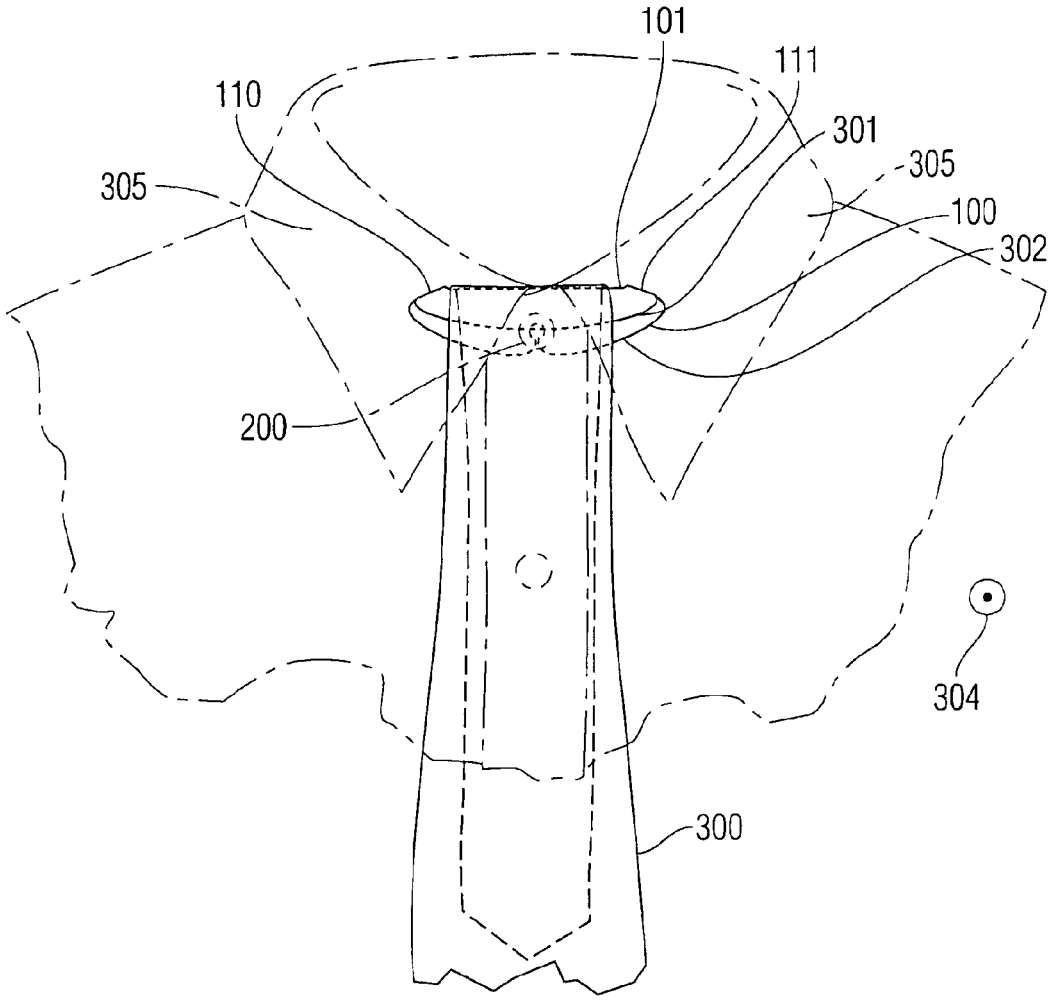
FIG. 3 is a diagram of the necktie holder of FIG. 1 with a necktie attached to it.

FIG. 3 is a depiction of a preferred way of attaching a tie 300 to the necktie holder 100. The necktie holder 100 is itself attached to a shirt button 200 as described above. The necktie holder is also folded along scorelines 110 and 111. The flexible nature of the plastic used allows for the necktie folder to be folded without cracking. Furthermore, the necktie holder 100 exhibits resiliency when folded. When folded, the necktie holder 100 comprises two portions 301 and 302 each of which reside within a different plane, the two planes having an acute angle therebetween and intersecting along the line defined by scorelines 110 and 111. The tie slot resides in portion 301, away from and above the shirt button 200. The channel 102 as well as the interior mouth 105 reside in portion 302 abutting the shirt 202. Portion 301 is folded over portion 302 The necktie 300 is inserted into tie slot 101 as shown in FIG. 3. The necktie is folded and laid out over portion 301 Thus, the necktie 300 covers most of portion 301 as well as portion 302 which remains under portion 301. Only the sides of portions 301, and 302 remain not covered by the necktie. The sides are covered by the collar 305 of the shirt. Thus, the entire necktie holder 100 is entirely concealed from view when in use.

Furthermore, due to the resiliency of the plastic, the necktie holder exhibits a tendency to unfold, but since it is engaged to the shirt 202, portion 301 is th eonly part of the necktie holder that is able to move. That portion exerts an outward force (in direction 304) to lift a top portion of the necktie 300. Thus, the top portion of the necktie is slightly raised from the shirt between the collars 305 thereby evoking a representation of a necktie knot.

Figure 4:
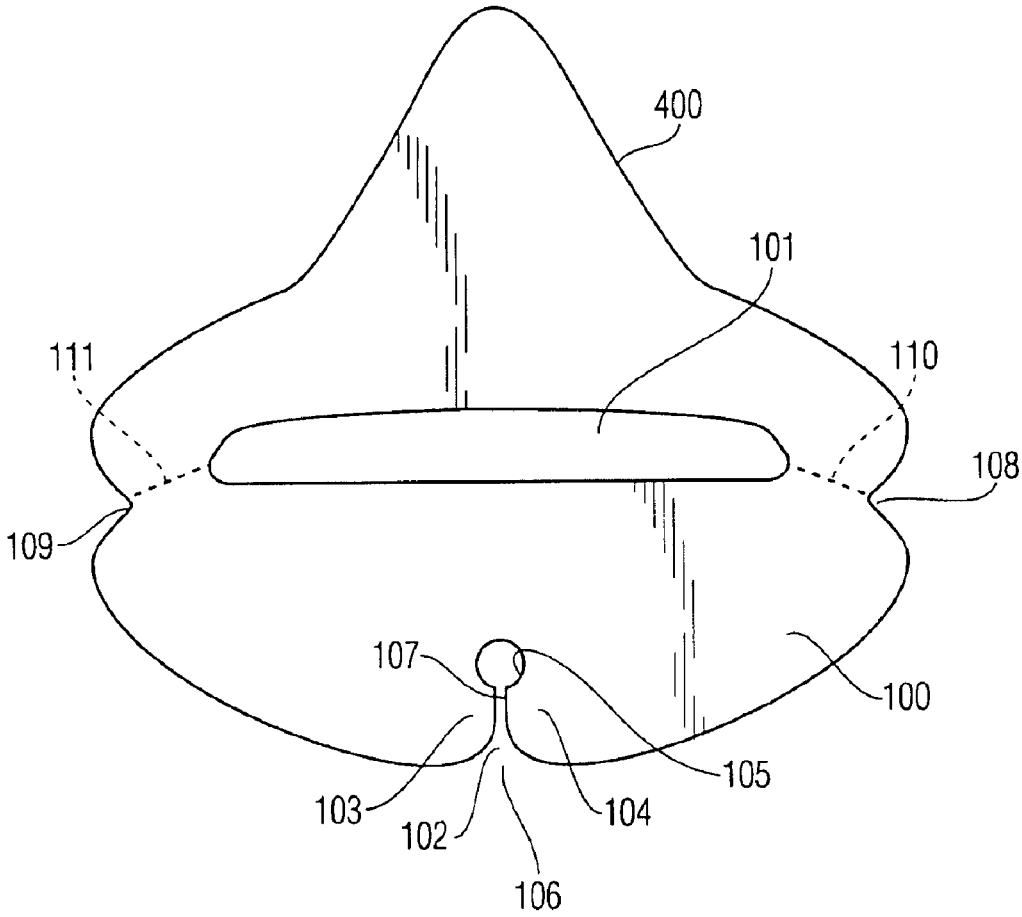
FIG. 4 is a diagram of the necktie holder in accordance with an alternate embodiment of the invention.

FIG. 4 shows an alternative embodiment of the necktie holder 100. A finger 400 is added to the upper portion of the necktie holder 301 The finger 400 modifies the lifting effect of the portion 301 on the necktie 300, when the necktie holder is in use, and thus it gives the necktie a different shape when engaged to a shirt.

In use, a necktie is secured to a shirt a shirt having buttons extending up to a collar, each shirt button being attached to the shirt by threading, in accordance to the following steps. A shirt button is selected and passed into the channel of a flexible plastic necktie holder resiliently beyond the constriction. The threading of the selected button is urged past some preexisting constrictions of the necktie holder, until the selected shirt button is seated beyond these constrictions. An example of such constriction is the constriction 107. A length of the necktie is disposed in a tie slot within the necktie holder. The necktie is folded over the necktie holder in order to conceal it. The necktie holder is then bent and the folded so as to place the folded necktie over the selected button. Thus, the necktie is secured to the shirt and the plastic holder is concealed beneath the necktie.

The invention has been described in connection with a particular embodiment thereof but is more broadly defined by the claims appended hereto.

I claim:

1. A necktie holder for attachment to a shirt under a shirt button, the shirt button being attached to the shirt by a threading having a width, the necktie holder comprising:

a flexible body having a tie slot sized for the placement of a tie therein wherein the tie slot resides in a first plane;

a channel defined in the flexible body and extending to an interior mouth, wherein the interior mouth resides in a second plane which is different than the first plane, when the necktie holder is attached to the shirt; and first and second shoulders opposedly positioned within the channel to define a constriction proximate the interior mouth, the constriction being smaller than the width of the threading whereby the button can be manually urged beyond the first and second shoulders while causing the constriction to resiliently flex the flexible body to momentarily permit passage of the shirt button into the interior mouth, wherein the first and second planes intersect at a hinge line that defines an acute angle therebetween.

2. The necktie holder of claim 1, wherein the flexible body is generally elliptically shaped and wherein the tie slot is aligned with a major axis of the flexible body.

3. The necktie holder of claim 1, wherein the channel has an access sized to receive the threading which is defined in the flexible body and wherein the access comprises a two-dimensional funnel.

4. The necktie holder of claim 1, further comprising indentations in the flexible body to permit folding the flexible body so as to position the tie slot out of plane with the interior mouth.

5. The necktie holder of claim 4, wherein the flexible body is resilient so that, when folded, the flexible body exerts a resilient force on a necktie attached to the shirt, the force being directed away from the shirt and causing a portion of the necktie to be positioned away from the shirt.

6. The necktie holder of claim 5, further comprising a finger extending away from the tie slot, which modifies force applied to the necktie.

7. A method for securing a necktie to a shirt having buttons extending up to a collar, each shirt button being attached to the shirt by threading, comprising the steps of:

passing a selected shirt button into a channel in a flexible plastic holder;

urging the threading of the selected shirt button past constrictions in the flexible plastic holder until the selected shirt button is seated beyond the constrictions;

disposing a length of the necktie in a tie slot of the flexible plastic holder;

folding the necktie over the flexible plastic holder to conceal the flexible plastic holder; and bending the flexible plastic holder so as to place the tie slot in a first plane and the interior mouth in a second plane which is different than the first plane the first and second planes intersecting at a hinge that defines an acute angle therebetween, and thus positioning the folded necktie over the selected button, whereby the necktie is secured to the shirt and the flexible plastic holder is concealed beneath the necktie.

8. The method of claim 7, wherein the passing step comprises passing a button that is proximate to the collar into the channel of the flexible plastic holder.

* * * * *